United States Patent [19]

Hardgrove

[11] 4,185,403

[45] Jan. 29, 1980

[54] SNOW REMOVAL AND TRANSPORT DEVICE

[76] Inventor: William H. Hardgrove, R.R. 2, Box 435, Libby, Mont. 59923

[21] Appl. No.: 925,386

[22] Filed: Jul. 17, 1978

[51] Int. Cl.[2] ..... E01H 5/02

[52] U.S. Cl. ..... 37/53; 294/55; 294/57; 294/59; 15/257.1; 15/257.7

[58] Field of Search ..... 37/53, 130, 40, 123; 294/54, 55, 57, 59, 19 R; 15/257.1, 257.7, 257.9

[56] References Cited

U.S. PATENT DOCUMENTS

| | | | |
|---|---|---|---|
| 1,556,433 | 10/1925 | Folkel | 37/53 X |
| 2,666,662 | 1/1954 | McLeod | 294/55 |
| 3,659,891 | 5/1972 | Pettenon | 294/55 X |
| 3,688,483 | 9/1972 | Hamilton | 294/55 X |
| 3,711,141 | 1/1973 | Soergel | 294/55 |
| 3,733,099 | 5/1973 | Szita | 294/55 |
| 3,754,785 | 8/1973 | Anderson | 294/55 X |
| 4,094,543 | 6/1978 | Fratini | 294/54 |

*Primary Examiner*—E. H. Eickholt

[57] ABSTRACT

A scoop like frame releasably mounts a trailing plastic bag to pick up snow from the earth and transport it. The back of the bag is provided with a drawstring closure mechanism to open the bag for snow deposition after transport. The frame has an associated forwardly extending handle mechanism to aid transport and allow change of frame position between the scooping mode and transporting mode.

4 Claims, 7 Drawing Figures

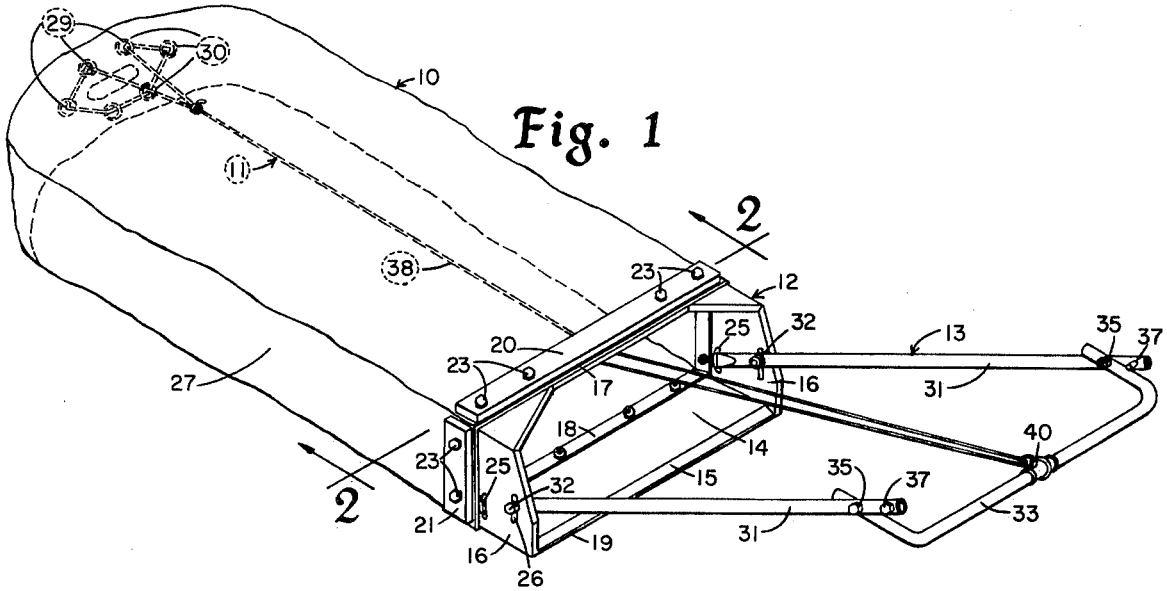
Fig. 1
Fig. 2
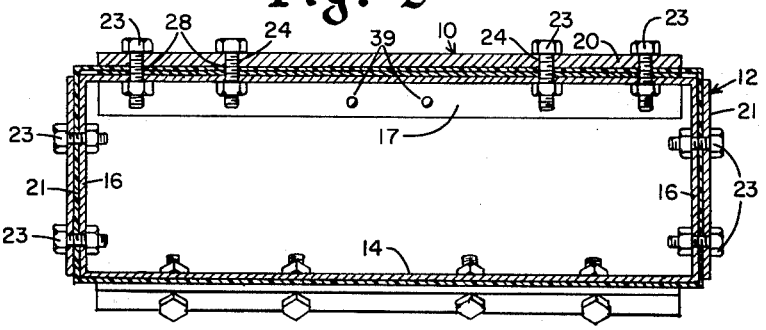
Fig. 3
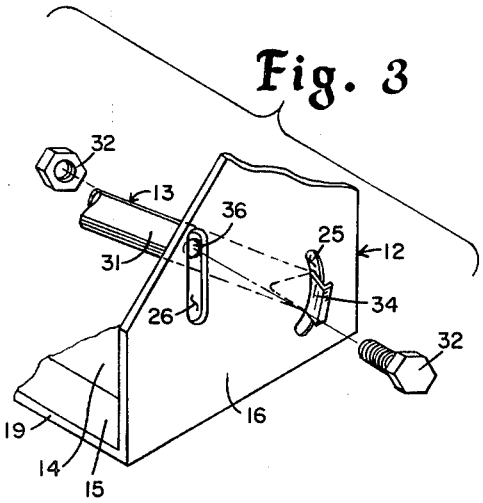
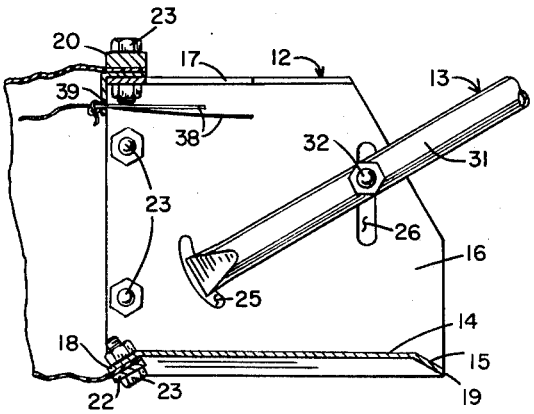
Fig. 4

SNOW REMOVAL AND TRANSPORT DEVICE

BACKGROUND OF INVENTION

1. Related Applications

There are no applications related hereto now filed in this or any foreign country.

2. Field of Invention

My invention relates generally to manually operable excavating devices for snow removal and more particularly to such devices that have a flexible bag for snow collection, transportation and deposition.

3. Description of Prior Art

Many devices commonly used for snow removal, whether manually or mechanically operated, require expenditures of excessive amounts of energy in moving snow greater distances than necessary, especially vertically against the force of gravity. This problem is common in the typical snow shoveling operation or the typical snow blower. The problem has heretofore been recognized and various excavating type devices of both the pushing and pulling types similar to those commonly used in earth moving have become known. This type of device generally lessens the total amount of energy required to remove snow especially by moving it through no greater vertical distance than necessary. These devices, though helpful, have not completely solved the snow removal problems especially in manually operated snow removal tools as they do not necessarily minimize the energy required for snow removal: they oftentimes do not allow deposit of the removed snow at a convenient or desirable place; and they oftentimes do not provide for snow transport or do not handle sufficient quantities of snow to make transport efficient. The instant invention seeks to provide a new and novel manually operated snow removal and transport device that uses modern material advantageously to provide better solutions to these problems.

I provide a rigid scoop with a trailing elongate smooth surfaced bag of plastic to receive and transport snow on an underlying supportable snow covered surface. Plastic is ideally suited for this purpose because it provides a low friction sliding contact with an underlying snow surface and because its pliable nature allows ready conformation with that surface without excessive physical disturbance, both to allow the efficient sliding transport of the snow filled plastic bag over the supportative surface with expenditure of a small amount of energy. The tool is also of relatively low mass, which again, does not require the expenditure of much energy in moving it over a distance. The flexibility of the bag allows closure of the rearward end by a drawstring type mechanism so that the rearward end might be readily opened, from a distance at the operator's position, at the end of snow transport to allow ready disposition of transported snow.

The provision of a scoop-like frame with a trailing bag of flexible material to collect snow or other material has heretofore become known, per se. In general such devices have been concerned with the collection of material other than snow and especially various herbage and yard debris. This type of known device has generally collected and contained the debris in a bag for later disposition in the containing bag and therefore has not provided a reusable type bag with a secondary closable orifice that allows ready removal and deposition of the bag's contents. Again, known devices have commonly been concerned only with a scooping or filling mode of use and commonly have not provided any particular means of effectively or efficiently transporting the filled bag, whereas the instant invention provides a handle structure that allows manual determination of either a filling or transport mode to allow transport of relative large loads. My invention also provides a relatively large bag for snow transport to make that transport efficient, whereas prior art devices commonly provided a relatively small bag because their use was more concerned with the collection and containment of debris rather than its transport and if the mass of such debris became too great during collection further motion would be too difficult. All of these functional advantages are particularly and essentially related to the structure of my invention and are uniquely combined in it to distinguish it from the prior art.

SUMMARY OF INVENTION

My invention generally provides a rigid scoop-like frame with forward handle means and a trailing flexible bag with drawstring type closure means in the rearward end. The scoop-like frame defines a rigid periphery for releasable attachment of the mouth of an elongate flexible bag. The frame defines a ramp in its lower surface that may be adjustably positioned by manual manipulation of the forwardly extending handle from a scooping mode with the forward portion of the ramp lowered to a transport mode with the forward portion of the ramp raised. The flexible bag is preferably formed of sheet plastic or similar low friction material to provide a pliable container with a drawstring type closure in its rearwardmost part. The closure drawstring communicates forwardly to a pivotable portion of the forwardly extending handle which may be moved to cause the drawstring to open the the rearward closure in the bag as desired for deposition of contained snow. The flexible bag is releasably attachable to the scoop frame to allow replacement when necessary. The whole device may be disassembled for convenient and compact storage.

In creating such a device it is:

A principal object of my invention to create a manually operable scoop-type excavating tool for snow removal that has a relatively large flexible bag for snow transport and deposition.

A further object of my invention to provide such a device that has an associated forwardly extending handle that may be manipulated to move the scoop portion of the device to either a scooping or transporting mode.

A further object of my invention to provide such a device that has an orifice with an associated drawstring type closure means in the rearward part of the flexible bag with the drawstring communicating to a pivotable portion of the forwardly extending handle to allow opening and closure of the bag upon pivot of the pivotable portion of the handle.

A still further object of my invention to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout:

FIG. 1 is an isometric surface view of my invention showing its various parts, their configuration and relationship.

FIG. 2 is a cross-sectional view of the invention of FIG. 1, taken on the line 2—2 thereon in the direction indicated by the arrows, to show the detailed structure of the scoop.

FIG. 3 is a partial, somewhat enlarged, exploded isometric view looking at the outside of a part of the side of the scoop frame to show the manner of attachment of the handle thereto.

FIG. 4 is a partial orthographic view from the inside looking outwardly at the structure illustrated in FIG. 3.

DESCRIPTION OF THE PREFERRED EMBODIMENT

Figure 5:
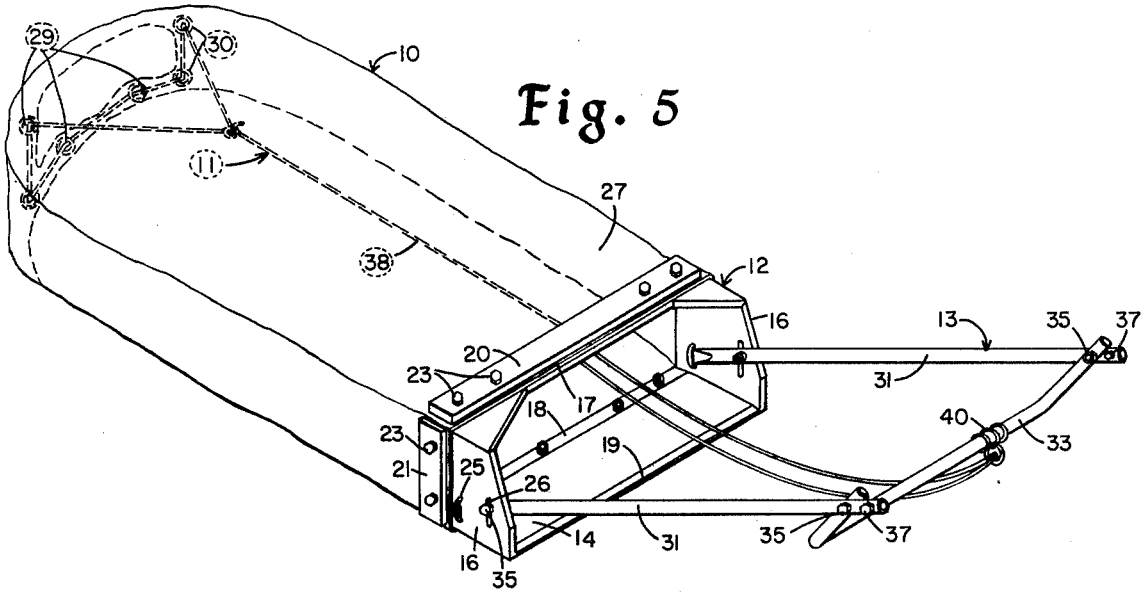
FIG. 5 is an isometric surface view of my invention, similar to that of FIG. 1, but showing the closure mechanism in relaxed or semi-open condition.
Figure 6:
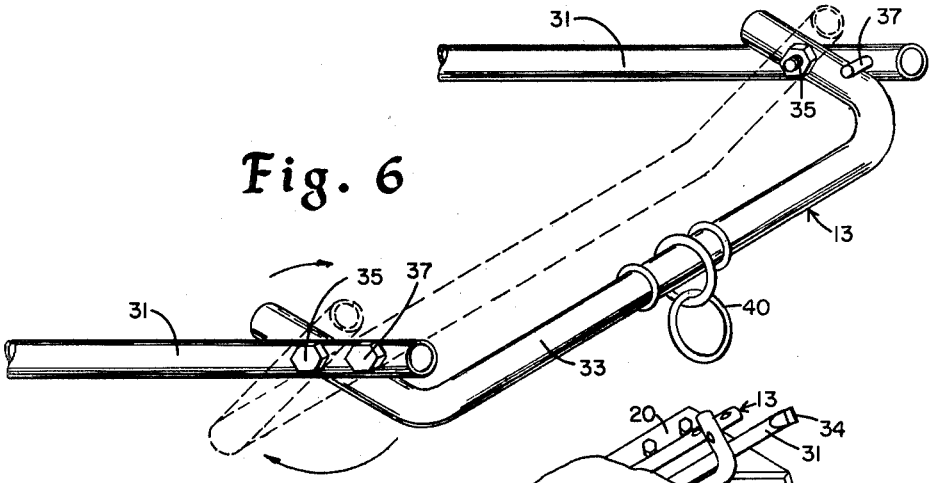
FIG. 6 is a partial, somewhat enlarged, isometric view of the handle of my invention showing the pivotable portion that controls bag closure in the closed mode, with a dotted phantom view showing the open mode.

My invention provides generally peripheral scoop frame 12, releasable carrying flexible transport bag 10 having closure mechanism 11, and pivotably supporting forwardly extending handle 13.

Scoop frame 12 comprises bottom scoop element 14 with substantially linear forward scooping edge 15 structurally communicating with similar opposed upwardly extending sides 16 which in turn structurally communicate with top element 17 to form a rigid peripheral frame through which snow may enter into bag 10. Bottom scoop element 14 is formed with downturned rearward margin 18 and downwardly sloping forward margin 19. This construction allows for attachment of a bag with minimal interference, presents a rigid scooping edge 15 across the lower forward part of scoop element 14 and provides additional rigidity.

The rearward portions of the elements forming the scoop frame are provided with means of releasably attaching bag 10, in this instance attachment strips 20, 21, 22 extending respectively along the top, both sides and bottom of the scoop frame and being releasably attached thereto by means of plural nut-bolt combinations 23 extending through opposed cooperating holes 24. Bottom attachment strip 22 is appropriately sized to fit immediately rearwardly adjacent rearward downturned margin 18 of bottom scoop element 14 so that it and the attaching nut-bolt combination 23 cause a minimum of interference in moving the tool over some underlying supporting surface (not shown).

The scope frame structure described is preferably formed of some rigid durable lightweight material such as sheet metal and particularly aluminum. The rectangular configuration illustrated is not essential. The scoop frame may be formed in various cross-sectional shapes so long as scooping edge 15 of bottom scoop element 14 is substantially conformable with the surface which it is to clean. Commonly, however, this will require substantially linear configuration. The dimensioning of the tool, again, is variable within wide limits but for common operation under normal conditions a width of about 26 inches and a depth (forward-rearward dimension) of about 7 inches is preferred.

Bag 10 is an elongate tubular structure having a peripheral dimension substantially the same as scoop frame 12 and at least not any smaller. The forward portion of the bag is provided with plural spaced fastening holes 28 through which the bolts of nut-bolt combinations 23 may pass when the bag is positioned as illustrated in FIG. 1, between the scoop frame and fastening attachment strips. These holes may be pre-formed or may be established by manipulation of the bolts themselves at the time of initial placement. The rearward portion of bag 27 inwardly of the rearward edge is provided with plural spaced fastening holes 29 positioned immediately inwardly of the rearward edge of the bag. Preferably, but not necessarily, these holes are re-enforced with annular gromets 30 to provide additional strength. The number and spacing of the holes is not critical but should be appropriate to cooperate with closure cord 38 at the rearward end of the bag sufficiently to hold snow. Bag 10 is formed of some reasonbly strong pliable material that has a relatively low coefficient of friction on a snow surface. I have found plastic material, and particularly plastics formed of polyethylene and polyvinyl, in sheet form to be ideally suited for the purposes of my invention. Plastic material of a 6 mill thickness is appropriate for most purposes though generally the heavier the material is the greater is its durability. Since my tool is commonly exposed to adverse weather conditions and environs relatively rich in ultraviolet radiation, some appropriately shielded plastic is preferred to prevent excessive deterioration. The dimensioning of the bag is not critical but commonly to provide a nice fit about scoop frame 12 its periphery should be substantially the same as that of the scoop frame and to provide appropriate snow carrying capacity and yet allow relatively easy manipulation the bag's length should be approximately 3 or 4 times the width of the scoop frame.

Handle 13 comprises similar opposed elongate tubular side elements 31 pivotably interconnected in their forward portion by rivets 32 with "U" shaped handle bar 33 extending therebetween as seen particularly in the illustrations of FIGS. 4 and 5. The forwardmost portions of side elements 31 carry inwardly extending stop pins 37 outwardly of rivets 32 to limit the upward pivotable motion of "U" shaped handle bar 33. The rearwardmost portion of each side element is flattened and bent to form "S" shaped hook 34 for attachment to each of side elements 16 to the scoop frame as illustrated particularly in FIGS. 3 and 4. A somewhat lower rearward arcuate slot 25 and a somewhat higher forward vertical slot 26 are provided in each side element 16 of the scoop frame. Rearward arcuate slot 25 is sized to movably accept hook 34 of side element 31 and is of a length somewhat greater than that of the hook element to allow its motion in the slot. Fastening hole 36 is provided in the inner end portion of each side element 31, appropriately positioned to cooperate with nut-bolt combinations 35 extending therethrough to fasten the handle to the side element with the bolt of that combination extending in a slidable fit through vertical slot 26. With ths structure then when an upward or lifting force is manually created upon handle bar 33, forward scooping edge 15 of scoop frame 11 will ultimately be lifted upon sufficient motion from the handle and will have no scooping action when it be moved forwardly over a supporting surface, but if that upward force be removed the forward scooping edge will move downwardly by action of gravity and rest with the forward margin of scoop element 14 upon a supporting surface and extending angularly downwardly to cause a scooping or planing action to pick up snow if the tool be pulled forwardly in that condition.

Closure mechanism 11 provides elongate closure cord 38 passing through fastening holes 29 alternately from one side of the flexible bag to the other. One end of the closure cord is fastened to the cord body at an appropriate medial position to form a loop in the cord sufficiently large to allow the rearward portion of bag 10 to fully open. The cord body, forwardly of the loop then passes forwardly through cord hole 30 in top element 17, thence forwardly to a slidable connection 40 with the mid portion of the "U" shaped handle bar 33, and thence rearwardly to fixed communication with the medial portion of top element 17 of the scoop frame, all as illustrated particularly in FIG. 1. The slidable connection 40 of the closure cord with the handle bar as illustrated provides a ring carried by the handle bar but well could be a pulley or some other similar type of connection. The length of cord 38 is so adjusted that when "U" shaped handle bar 33 is in its forwardmost position, as illustrated in FIG. 1, the rearward end portion of bag 10 will be closed but when the handle bar be pivoted rearwardly, to the position illustrated in FIG. 5, the rearward portion of bag 10 may be open. Obviously this function is also related to the length of the legs of the handle bar 33 and they should be so dimensioned as to accomplish the function.

Having thus described the structure of my invention its operation may be understood.

Firstly a device is formed and assembled according to the foregoing specification. To pick up snow with it, it is maintained in the condition illustrated in FIG. 1 with "U" shaped handle bar 33 in a forward position against stop pins 37 but with no upward force raising scooping edge 15 above the surface supporting the device. In this condition the handle bar is pulled by appropriate manual force to move the device forwardly so that scooping edge 15 digs downwardly into underlying snow and causes the snow to pass rearwardly into the interior of bag 10. Actually from an outside reference point the tool really substantially moves under the snow and much of the snow remains substantially stationery. The device is pulled forwardly until bag 10 is appropriately filled with snow at which time "U" shaped handle bar 33 is manually raised slightly so that scooping edge 15 moves to position its forward edge above its rearward edge. In this condition the device is again pulled forwardly and the scooping element 14 will move upwardly to ultimately ride above the underlying supporting snow surface. The device may in this condition be easily propelled over the supporting snow surface for a distance to transport the snow contained in bag 10 to a position for disposition. When this terminal point is reached handle bar 33 is rotated rearwardly to its rearwardmost position and the device pulled sharply forward. The purse type closure 11 in the rearward portion of the bag 10 will have been relaxed and the sharp forward motion will cause the snow in bag 10 to remain stationary by reason of its inertia while the lighter bag will move forwardly, all to open the closure and remove the bag from the contained snow to thusly, in effect, deposit it. After disposition of the snow, handle bar 33 may again be rotated forwardly and the device is ready for reuse.

Figure 7:
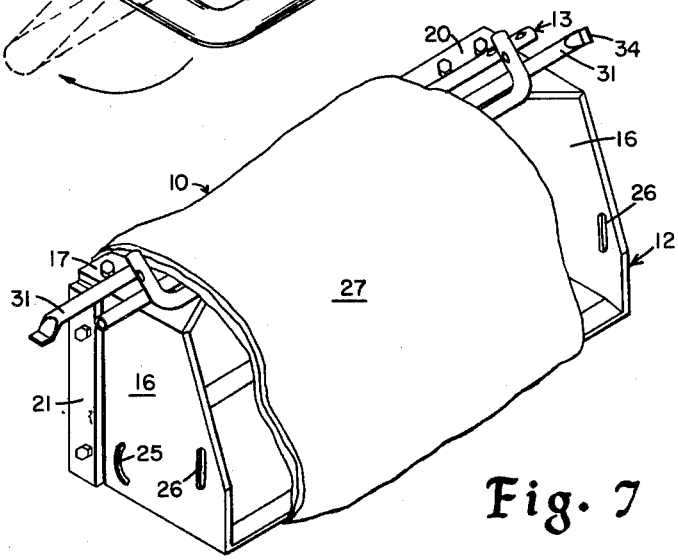
FIG. 7 is an isometric surface view of my invention disassembled and rolled for storage.

It should be noted, as illustrated particularly in FIG. 7, that the handle structure may be readily taken apart and laid across the scoop element 12 and bag 10 rolled thereabout for simple, easy and convenient storage. The invention in this condition has a relatively small volume.

It should be further noted that in transporting snow in the method described, the transported snow is not lifted to any substantial degree vertically above its supporting surface at least by reason of the removal process. Normally removed snow may be transported downwardly or at least on a level course to alleviate any extended exertion of energy for transportation. In this regard it should also be noted that the undersurface of bag 10 presents a very low frictional contact with an underlying supportative snow surface.

The foregoing description of my invention is necessarily of a detailed nature so that a specific embodiment of it might be set forth as required, but it is to be understood that various modifications of detail, rearrangement and multiplication of parts may be resorted to without departing from its spirit, essence or scope.

Having thusly described my invention, what I desire to protect by Letters Patent, and what I claim is:

1. A manually operated tool for removal and transport of snow for disposition, comprising, in combination:

a peripherally defined rigid scoop frame having a top interconnecting similar, substantially vertical sides and an elongate bottom element with a substantially planar downturned forward margin;

a handle extending forwardly and upwardly from pivotal joinder with the scoop frame, the handle comprising similar elongate side elements pivotably communicating in their rearward parts with the sides of the scoop frame for limited pivotable motion relative to the scoop frame to change the angular orientation of the bottom element of the scoop frame relative to an underlying supportative surface between a scooping mode and a transporting mode responsive to a handle motion, each side element being pivotably interconnected in its forward part by a "U" shaped handle bar extending therebetween and limited in its pivotable motion relative to the side elements from a rearward to a forward position;

an elongate flexible bag releasably communicating about the scoop frame and extending rearwardly therefrom with a closable opening in the rearward part of the bag; and closure means associated with the flexible bag to allow pre-determined opening and closing of the rearward opening therein defined responsive to pivotable motion of the "U" shaped handle bar.

2. The invention of claim 1 further characterized by:

the elongate flexible bag being formed of polymeric plastic material having at least an outer surface that creates a relatively low sliding frictional contact with an underlying supportative snow surface.

3. The invention of claim 1 further characterized by the closure means associated with the flexible bag comprising:

plural spaced holes defined in the flexible bag adjacent the periphery of the rearward opening defined therein; and an elongate flexible closure cord having a first end portion laced from alternate sides of the bag through adjacent holes defined in the bag with the first end of the closure cord being tied to its middle part to form a loop therein substantially the same as the opened orifice in the flexible bag and the second end of the closure cord movably supported by the handle bar and thence fastened to the scoop frame so that the rearward orifice in the flexible bag may be opened and closed responsive to pivotable motion of the handle bar.

4. The invention of claim 1 wherein the pivotable joinder of the handle to the scoop frame is further characterized by:

the rearward ends of the handle side elements, each defining "U" shaped hooks each slidably carried in arcuate slots defined in similar lower rearward portions of the opposed vertical sides of the scoop frame; and each handle side element having a fastening hole at a spaced distance forwardly of the "U" shaped hooks with a nut and bolt combination extending therethrough and through vertical slots defined in similar positions in the scoop sides forwardly and above the arcuate slots.

* * * * *